US005768833A

United States Patent [19]

Golen

[11] Patent Number: 5,768,833

[45] Date of Patent: Jun. 23, 1998

[54] STORM SHUTTER RETAINER ASSEMBLY

[76] Inventor: Selig Golen, 5137 NW. 93rd Doral Way, Doral Estates, Miami, Fla. 33178

[21] Appl. No.: 488,153

[22] Filed: Jun. 7, 1995

Related U.S. Application Data

[63] Continuation-in-part of Ser. No. 260,332, Jun. 15, 1994, abandoned.

[51] Int. Cl.[6] ..... E06B 3/26

[52] U.S. Cl. ..... 52/202; 52/203; 52/207; 52/9.12; 49/464; 49/61; 248/547; 248/488

[58] Field of Search ..... 52/202, 203, 207, 52/11, 2.12; 248/547, 495, 493, 488; 49/464, 463, 460, 57, 61, 62

[56] References Cited

U.S. PATENT DOCUMENTS

| | | | |
|---|---|---|---|
| 3,478,997 | 11/1969 | Goss | 248/488 |
| 4,223,481 | 9/1980 | Page | 49/63 |
| 4,333,271 | 6/1982 | De Paolo et al. | 49/464 |
| 4,637,583 | 1/1987 | Babitz | 248/547 X |
| 4,685,261 | 8/1987 | Seaquist | 52/202 |
| 4,825,609 | 5/1989 | Rundo | 52/202 |
| 4,956,950 | 9/1990 | Hirose | 52/11 X |
| 5,178,355 | 1/1993 | Herzig | 248/493 X |
| 5,337,988 | 8/1994 | Kurtz | 248/495 X |
| 5,345,716 | 9/1994 | Caplan | 49/464 X |
| 5,347,775 | 9/1994 | Santos | 49/464 X |
| 5,430,982 | 7/1995 | Bane | 52/202 |
| 5,487,244 | 1/1996 | Hill | 52/202 |

*Primary Examiner*—Carl D. Friedman
*Assistant Examiner*—Winnie Yip
*Attorney, Agent, or Firm*—Malloy & Malloy, P.A.

[57] ABSTRACT

A storm shutter retainer assembly featuring a header structure incorporating an elongated retaining channel defined by front, rear, and top flanges integrally attached to one another in at least partially surrounding relation to the retaining channel and defining the boundaries thereof wherein the upper peripheral edge of a conventional metallic or like storm shutter is retained within the channel. A connecting assembly includes a connector element mounted on and extending the rear flange at a particular upwardly angled configuration so as to resist upwardly directed cantilever forces exerted on the header structure by the storm shutter during severely adverse weather conditions.

6 Claims, 2 Drawing Sheets

STORM SHUTTER RETAINER ASSEMBLY

BACKGROUND OF THE INVENTION

The present is a continuation-in-part of previously filed, application Ser. No. 08/260,332, filed Jun. 15, 1994, now abandoned.

1. Field of the Invention

A retainer assembly for a storm shutter including a header structure having an elongated retaining channel therein and further incorporating a connecting assembly formed on the header structure within the channel to resist cantilever forces exerted thereon.

2. Description of the Related Art

In the conventional mounting of storm shutters to building structures in protective, overlying relation to windows, doors, or the like openings in such building structures, it is common practice to use a lower track to engage the lower peripheral edge of the storm shutter and an upper track which normally includes some type of channel in which to at least partially enclose in a retaining relation, the upper peripheral edge of the storm shutter. Such storm shutters are typically formed of a metal or like high-strength material to offer proper protection to the window, door, etc. being protected and over which the storm shutter is mounted. Also, a conventional construction of such storm shutters includes an alternating rib configuration or pattern which adds to the overall structural integrity of the storm shutter. During high wind or like adverse weather conditions, there is frequently some type of lifting force being exerted on the storm shutters which result in an upwardly lifting or cantilever force being exerted particularly on the upper header structure. In particular, a substantial negative pressure is exerted on a rear of the shutter panel causing to bow outwardly from its center. This bowing exerts a substantial upward cantilevered force which can not only result in the detachment of the mount, but can also lead to a small degree of movement by the mount such that the shutter panel, in its bowed state, can slide out of its retained position causing the entire shutter panel to be ejected, often at dangerous velocities.

In related art structures of this type, the portions of the header structure defining and somewhat surrounding a retaining channel also includes an outwardly extending mounting flange which is co-planar and integrally formed with a rear flange on the header structure. Connected elements such as threaded screws or the like are fastened to the outer wall of the building structure on which the storm shutters are mounted by passing the connector elements or screws directly through the mounting flange in perpendicular relation thereto. While at partially effective, such an arrangement does have certain disadvantages. For example, in certain communities, only certain types of connector elements are approved for use. These connector elements are frequently painted a very noticeable color to protect it against rust. Also, as set forth above, these connector elements or screws are driven perpendicularly through the mounting flange into the outer wall or surface of the dwelling being protected. By virtue of this collective placement of the connector elements and the existence of the mounting flange, such a structure is somewhat less resistant to the aforementioned cantilever forces exerted on the header structure by the upwardly lifting force or tendency of travel of the storm shutter during extremely high wind or adverse weather conditions.

Additionally, in the unrelated art associated with window molding, such as in the patent to Rundo (U.S. Pat. No. 4,825,609), it is seen that a fastener screw is inserted at an angled orientation. Such angle orientation is a matter of necessity in some molding designs because the interior support surface to which the screw will be fastened is not co-planar with the item being fastened, and/or there are perpendicular support surfaces available to provide support, and as such no disclosure or suggestion is provided that said orientations for the purpose of minimizing a cantilevering force on an item secured to a single, vertical support surface. In fact no disclosure or suggestion is present in the prior art for affirmatively and supportedly angling a securing screw for a shutter assembly in order to counteract a cantilevered force. Further, such angled screws are positioned at a corner between perpendicularly adjacent sides, and as a result, as the screw is tightened a portion of its tightening force is focused on the perpendicular surface. This force on the perpendicular surface in fact leads to a cantilevering force on the assembly, however in the unrelated art of window molding, because both surfaces have an underlying support surface such that cantilevering forces are generally not a concern.

Additionally, in the related art, most shutter assemblies require direct securing of the shutter panels themselves to the support surface. Accordingly, it would be highly beneficial to provide a storm shutter retention system which requires a minimal amount of screws and in fact is capable of securing a shutter panel in place without the need to secure a plurality of screws through the shutter panels themselves. Further, it would be advantageous to provide a retention system which will permit forward entry mounting of the shutter panels rather than a side entry mounting which can often be difficult to effectively implement. Nevertheless, a shutter assembly wherein the shutter panels are not directly secured to the support structure focuses a great deal of the outward bowing force of the panels on the retention members rather than the screws of prior art systems which pass through the panels directly. Therefore, such systems have an even greater, and as yet unrecognized, susceptibly to outward cantilever forces on the retention assemblies of the shutter system, which can detach the assemblies from the support structure and/or "pop" the shutter panels out from their retained position.

Based on the above, there is a need to improve the retainer assemblies available for a storm shutter by improving the connecting assembly to the extent that the connector elements themselves are not visible or observable from the exterior of the mounted storm shutter and the header structure attached to the upper peripheral edge thereof but are hidden so as to be out of sight. Also, the specific mounting and orientation of such connector elements may constitute a very meaningful improvement in the resistance to overcome any possibly destructive cantilever forces exerted on the header structure and the storm shutter as well.

Also, the removal or repositioning of the connector elements from the prior art devices, as described above, to a position within the retaining channel in somewhat "hidden" locations will prevent access to these connector elements to vandals and thereby make it extremely more difficult to remove the storm shutters by unauthorized personnel.

SUMMARY OF THE INVENTION

The present invention is directed towards a storm shutter retainer assembly wherein generally conventionally constructed storm shutters made of metal or like high strength material and also incorporating an alternating ribbed construction are mounted in removably attached relation to a building structure in overlying and protective relation to a door, window, or like opening. Storm shutters of this type of course are used to protect the doors, windows, etc. under severe adverse weather conditions. Accordingly, their secure attachment in the protecting position is important.

The present invention incorporates as an important part of the storm shutter retainer assembly a header structure. The header structure includes a rear flange, a front flange spaced from the rear flange, and a top flange integrally connected to and serving to interconnect the rear and front flanges in spaced generally parallel relation to one another.

The front, rear and top flanges at least partially surround what may be referred to as a retaining channel. The header of course has an elongated configuration and the aforementioned retaining channel extends along the entire length of the header channel wherein the boundaries thereof, as set forth above, are defined by the rear flange, front flange, and top flange. This channel is specifically dimensioned, configured, and overall structurally adapted to receive the upper peripheral edge of the storm shutter therein.

This header structure will differ from existing structures in other related art storm shutter retaining assemblies by virtue of the fact that a mounting flange existing in the prior art and extending upwardly from the top flange and being coplanar with the rear flange is non-existent. Again, in the prior art, such mounting flanges used to support and have secured thereto a plurality of connectors such as screws or the like. Such connectors, in the prior art, extend perpendicularly through the mounting flange and into the outer wall of the building structure on which the subject storm shutter is mounted.

The present invention differs from those structures already known in the art, as described above, by virtue of the fact that it includes a connecting means mounted within the channel and therefore out of the visual observation of any casual observer. The providing of the connecting means on the interior channel will in effect reduce vandalism or any other unauthorized attempt to remove the shutters from their protected position overlying the door, window, or like opening of the building structure.

More specifically, the subject connecting means includes at least one connector element extending through what may be referred to as a mounting base such that the connector element, which may be a screw, has an enlarged head positioned in confronting engagement with a mounting face on the mounting base of the connecting means and further wherein the mounting base includes an aperture extending therethrough. The shank portion of the connecting element or connecting screw passes through this aperture of the mounting base and wherein the free end thereof is embedded in the outer wall of the building structure on which the subject assembly is mounted. An additional important feature of the connecting means includes the fact that the mounting base as well as the through aperture formed therein are arranged at an upwardly directed angular orientation such that the free end is embedded in the outer wall structure of the base at an angle greater than that of a 90° or perpendicular angle. Therefore, the entire connector element once extending through the mounting base is disposed at such an upwardly angular orientation to resist any cantilever force exerted on the header structure when retaining the upper peripheral edge of the storm shutter.

The aforementioned cantilever forces are common during severely adverse weather conditions, especially high wind, wherein an upward lifting force is frequently placed on the storm shutter. Such upwardly lifting force provides the potentially harmful or destructive or cantilever forces being exerted on the header structure. Resistance to such harmful cantilever forces is better accomplished through the provision of the connector element, passing through the specifically structured mounting base at the upwardly existing angle as set forth above. It has been found that such connector element passing perpendicularly into the building through the use of an upwardly extending mounting flange on prior art devices does not as effectively resist the aforementioned harmful cantilever forces.

Other features to be described in greater detail hereinafter include a bottom track to which the panels of the storm shutter are attached. Such attachment may occur by means of wing nuts attached to outwardly protruding externally threaded shanks of various connecting members.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

With regard to the accompanying figures, the storm shutter of the type referred to herein is generally represented as 10 and is retained on some type of building or more particularly secured to an outer wall thereof generally indicated as 12. The outer wall of the, building has mounted thereon a header structure generally indicated as 14, to be described in greater detail hereinafter, and also has secured generally in the vicinity of the outer wall a lower track structure 16, or preferably a lower retainer assembly 16'.

Figure 1:
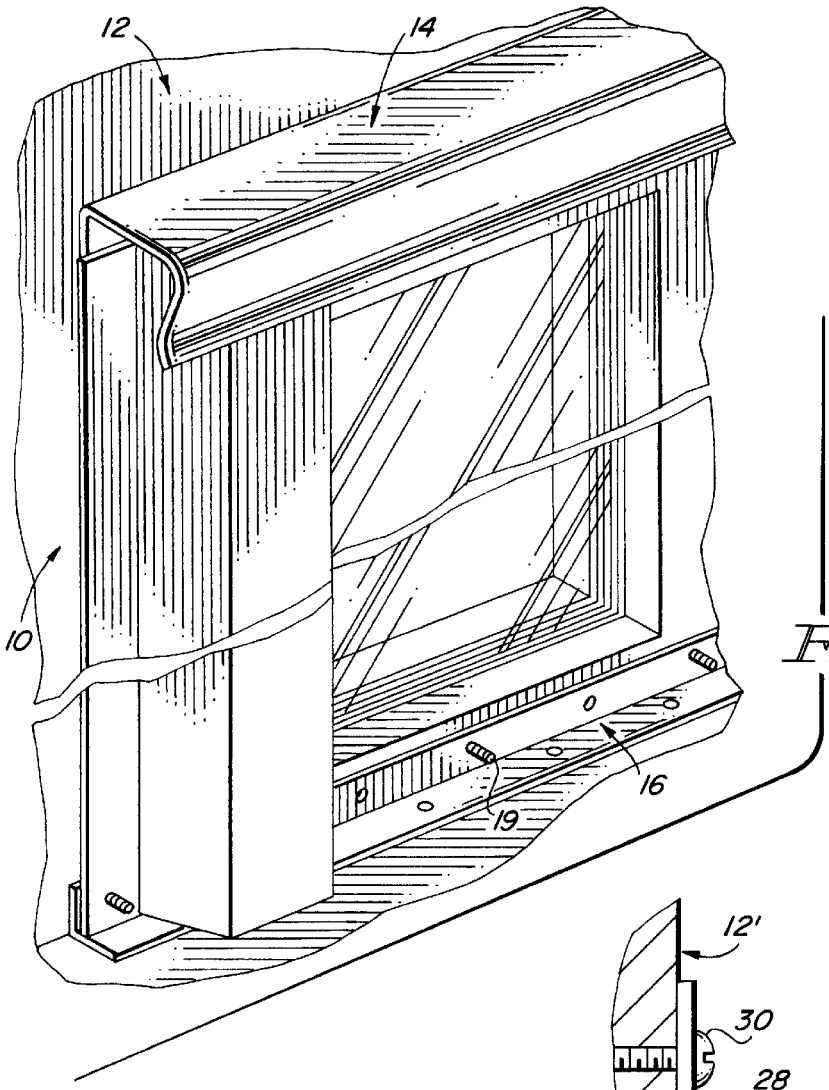
FIG. 1 is a perspective view of the present invention wherein at least a portion of the storm shutter assembly is retained in its protective position utilizing the storm shutter retainer assembly of the present invention.
Figure 3:
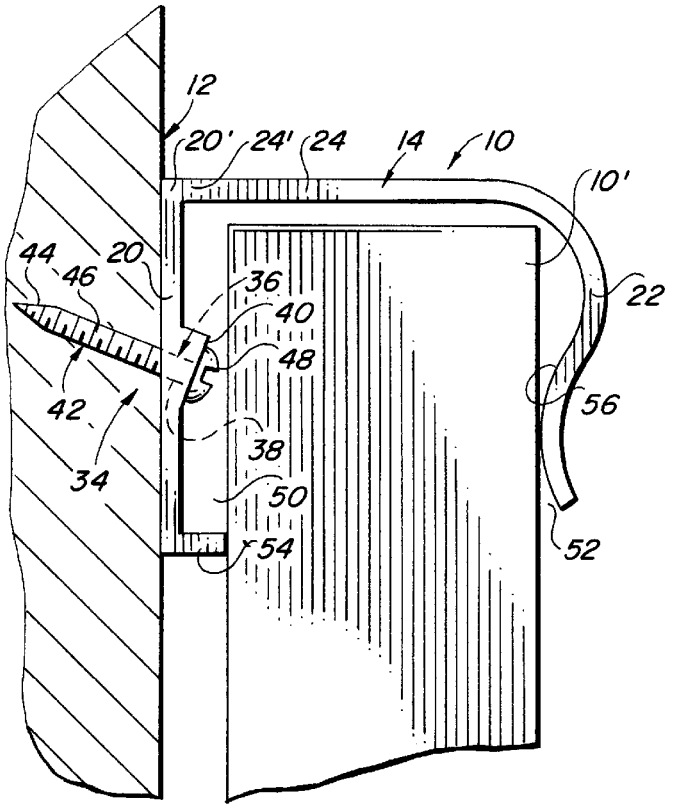

As clearly shown in FIG. 1, the storm shutter 10 may be of somewhat conventional design, formed of a metal or like high-strength material, and defined by an alternating ribbed construction. The header structure 14 serves to retain the upper peripheral edge as shown in FIGS. 1 and 3 and the lower peripheral edge is secured to the lower track 16 as clearly shown in FIG. 1. Attachment of the lower peripheral edge of the storm shutter panel or panels 10 includes the passing of connecting members, in the form of externally threaded shanks as at 19 through pre-formed holes in a portion of a shutter as clearly indicated. These shanks are covered by a wing nut arrangement to facilitate easy on and off connection to the lower track.

With reference primarily to FIGS. 1 and 3 the header structure 14 includes a rear flange 20, a front flange 22 disposed in spaced apart and somewhat downwardly extending parallel relation to the rear flange 20 and also a top flange as at 24. The top flange is integrally secured to both the rear flange 20 and the front flange 22 and serves to interconnect such flanges in their spaced apart relative location. The rear flange 20 and accordingly the entire header structure 14 of the present invention is absent any type of outwardly extending mounting flange 28 as shown in the prior art device of FIG. 2. Typically, this upwardly extending mounting flange serves to receive a plurality of spaced apart connector members generally indicated as 30. Such connector members, as shown, pass perpendicularly through the upwardly extending mounting flange 28 and perpendicularly into the outer wall 12' of the building structure as shown in FIG. 2.

Figure 2:
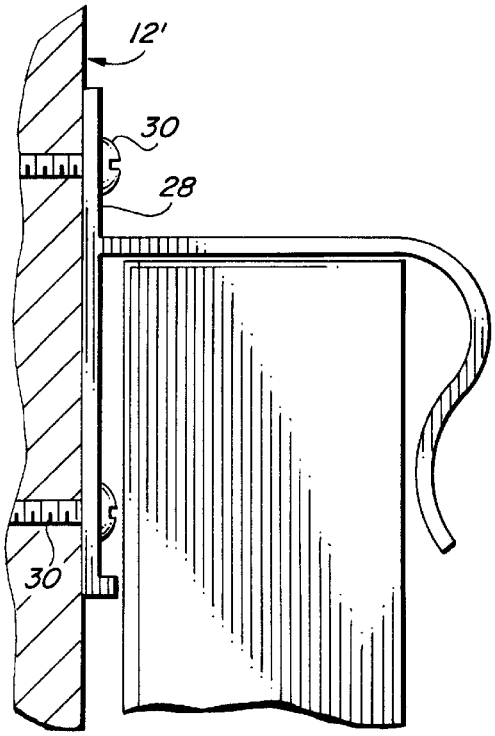
FIG. 2 (PRIOR ART)
FIG. 2 is an end view and partial cutaway of a prior art device.
Figure 4:
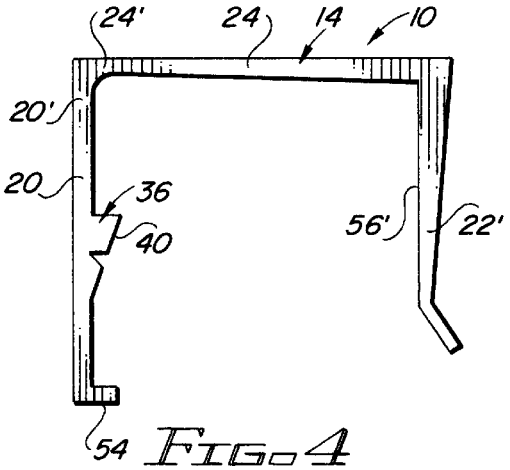
FIGS. 3 and 4 are end views of the header structure of the present invention.

To the contrary, the header structure 14 of the present invention is absent any type of mounting flange as represented in 28 of the prior art device of FIG. 2. Conversely, the rear flange 20 has its upper longitudinal edge terminating as at 20' at the juncture of a corresponding longitudinal edge 24' where it is integrally secured to the top flange 24.

Accordingly, and in order to avoid problems associated with the related art, the present invention includes connecting means generally indicated as 34. This connecting means includes a mounting base as at 36 having a somewhat wedge-shape cross-sectional configuration as clearly shown in FIG. 3. Further, an aperture indicated by broken lines 38 passes completely through the base as indicated as at 38. This aperture opens on a facing surface of the mounting base 36 wherein such facing surface is indicated as 40. An important feature of the particular structure of the connecting means is that the wedge-shape cross-sectional configuration of the base 36 allows for the extension of a connector member 42 to extend through the base and accordingly through the rear flange 20 at what may be considered an upwardly angled orientation rather than a perpendicular orientation as represented in the prior art structure of FIG. 2. In such angular orientation, the free end 44 of the shank 46, penetrates into the outer wall 12 of the building structure on which the header structure 14 is mounted and also is penetrated and is embedded in such wall 12 at the aforementioned upwardly angled orientation. In such a configuration, the facing surface 40 on the mounting base 36 also has a somewhat angular orientation so as to accommodate confronting engagement of the enlarged head portion 48 of the connector member 42. Further, the connecting base 36 and accordingly the head 48 of the connector element 42 are all located on the interior of the retaining channel 50 wherein such retaining channel is defined by the rear flange 20, the top flange 24, and the front flange 22, such that the placement of such flanges at least partially surround and define the boundaries of this channel. The lower longitudinal side of the retaining channel 50 is open as at 52 to receive the upper peripheral edge 10' of the storm shutter or the various panels thereof.

Additionally, because the connecting base 36 is a solid member disposed along a main surface of the rear flange 20 and not at the juncture 20', the securing effects of the connector member 42 are maximized along the plane of the rear flange. Unlike prior art, unrelated devices which incorporate angled screws as a necessity due to the orientation of the support surface and placed at a corner between perpendicular, adjacent surfaces, the securing of the screw does not provide its own cantilevering force due to the force it exerts on the perpendicular surface. Rather, the securing force of the connecting member 42 and the cantilevering resistance of the rear flange are entirely focused on preventing a cantilevered movement of the header 14. Further, because the header 14 is to be secured at only a single vertical support surface, rather than at a corner between adjacent, perpendicular support surfaces, a greater susceptibility to cantilevering is present and is overcome by the specific structure of the upper retention assembly 14 of the present invention.

Other features of the present invention may include a spacer segment as at 54 integrally formed on the rear flange 20 and extending along the length thereof. This spacer segment 54 extends outwardly from the inner surface of the rear flange and into somewhat retaining engagement with an inner surface of the panel or panels defining the storm shutter 10. Similarly, an inner surface portion as at 56 of the front flange 22 also engages what may be considered an outer or exterior surface of the panel or panels defining the storm shutter 10 as clearly shown in FIG. 3. In the embodiment of FIG. 3, the front flange 22 may include somewhat of a curvilinear configuration such that the engaging portion of the inner surface as at 56 of the front flange curves inwardly as shown in FIG. 3. It is intended to be within the scope of the present invention that the front flange have a more linear configuration wherein some portion of the inner surface of the front flange engages the outer exposed surface of the storm panels defining the storm shutter 10.

Figure 5:
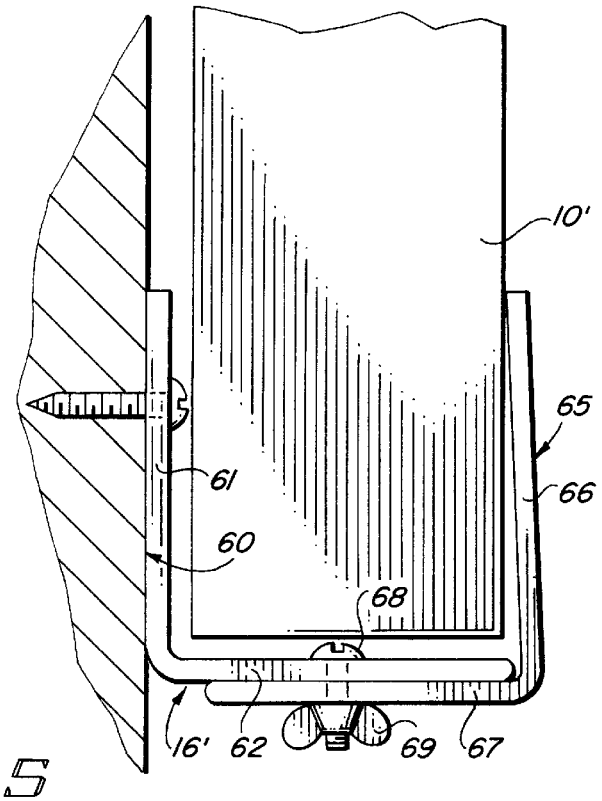
FIG. 5 is an end view of the lower retainer assembly of the present invention.

Additionally, the header 14 is preferably included as part of an overall storm shutter retainer system including the upper, header retainer assembly 14 and the preferred lower retainer assembly 16', best seen in FIG. 5. This lower retainer assembly 16' extends along an entire length of the window, much like the header 14, and includes a generally L-shaped base member 60 and a generally L-shaped lock panel 65. The generally L-shaped base member 60 includes primarily a planar flange 62 and a rear flange 61. Specifically, the rear flange 61 is structured to be fixedly secured in co-planar connection to the building structure. The planar flange 62, however, extends generally perpendicularly outward from the rear flange 61 and is structured and disposed to supportably receive a lower peripheral edge of the storm shutter 10' supportably thereon. In use, the L-shaped base member 60 alone is mounted in place prior to positioning the shutter panels 10'. Accordingly, due to the configuration of the base member 60, the shutter panels 10' may be received from an open front face of the base member 60, thereby permitting facilitated slided engagement of the upper peripheral edge of the storm shutter into said upper retainer assembly 14.

Turning to the generally L-shaped lock panel 65, it includes a lower lock flange 67 and an upwardly extending front flange 66 disposed generally perpendicular from one another. The lower lock flange 67 is structured for secure co-planar engagement with the planar flange 62 of the base member 60. Further, because the support structure to which the base member 60 is secured will generally not be completely perpendicular, as the lock flange 67 is secured to the planar flange 62, the front flange 66 will tend to be angled inwardly relative to the shutter panel 10' resulting in affirmative retention of the lower peripheral edge of the storm shutter within the lower retainer assembly 16'. It is note, however, that the front flange 66 may be angled inwardly relative to the lock flange 67 if necessary to achieve more affirmative retention of the shutter panel 10'.

Preferably, the generally L-shaped base member 60 and generally L-shaped lock panel 65 of the lower retainer assembly 16' are secured with one another by an elongate bolt or screw 68 that extends downwardly through the planar flange 62 and lock flange 67, and may include means to prevent the bolt 68 from rotating therein such as a washer or mating upper hub which extends into a corresponding recess in the planar and/or lock flanges 62 and 67. Finally a nut, preferably a wing nut 69 in tightened to secure the flanges in places. It is note, however, that a variety of securing means may be effectively implemented.

Accordingly, the system of the present invention which includes the upper retention assembly 14 and the lower retention assembly 16' may incorporate interlocking shutter panels 10' which need not be directly secured to the support structure. Because of the retention provided by the lower retention member 16' after positioning of the shutter panels 10', and because of the upper retention member's 14 ability to resist cantilevered forces the shutter panel is safely held in place in accordance with today's ever increasing code requirements.

Now that the invention has been described,

What is claimed is:

1. A storm shutter retainer system designed to attach a storm shutter to a building structure, said system comprising:

an upper retainer assembly comprising:

a) a header structure having an elongated configuration and a hollow interior extending along the length thereof to define a retainer channel within said header structure, b) said header structure including a rear flange and a front flange spaced outwardly from said rear flange, c) a top flange integrally attached to and interconnecting said rear and front flanges, d) each of said top, rear, and front flanges extending along the length of said header structure in collectively surrounding relation to said retainer channel, e) said retainer channel adapted for receiving an upper peripheral edge of the storm shutter in a retaining position therein, f) connecting means mounted at least partially within said retaining channel for securing said header structure to the building structure, g) said connecting means including a connector element extending through said rear flange and including a head portion disposed within said channel, said connecting means adapted to orient said connector element in an upwardly angled position to resist any upwardly directed cantilever forces exerted on said header structure through the storm shutter, and a lower retainer assembly comprising:

(a) a generally L-shaped base member, said base member including a planar flange and a rear flange, (b) said rear flange being structured and disposed for secure, planar connection to the building structure, (c) said planar flange being structured and disposed to supportably receive a lower peripheral edge of the storm shutter thereon, the storm shutter being received therein from an open front face of said base member so as to permit facilitated slided engagement of the upper peripheral edge of the storm shutter into said upper retainer assembly, (d) a generally L-shaped lock panel, said lock panel including a lower lock flange and an upwardly extending front flange, and (e) said lower lock flange being structured for secure co-planar engagement with said planar flange of said base member, co-planar securing of said lock flange to said planar flange resulting in affirmative retention of the lower peripheral edge of the storm shutter within said lower retainer assembly.

2. A storm shutter retainer system as recited in claim 1 wherein said lower lock flange of said lock panel of said lower retainer assembly and said planar flange of said base member of said lower retainer assembly are structured to be secured with one another by an elongate bolt disposed non-rotatingly therethrough and a nut secured on a free, exterior end of said bolt.

3. A storm shutter retainer system as recited in claim 1 wherein a generally rough, uneven nature of the building structure to which said rear flange of said base member of said lower retainer assembly is secured in a co-planar fashion results in an inward orientation of said front flange of said lock panel so as to affirmatively retain the lower peripheral edge of the storm shutter securely within said lower retainer assembly

4. A storm shutter retainer system designed to attach a storm shutter to a building structure, said system comprising:

an upper retainer assembly and a lower retainer assembly, said upper retainer assembly structured to maintain an upper peripheral edge of a storm shutter in a retaining position therein, said lower retainer assembly comprising:

(a) a generally L-shaped base member, said base member including a planar flange and a rear flange, (b) said rear flange being structured and disposed for secure, planar connection to the building structure, (c) said planar flange being structured and disposed to supportably receive a lower peripheral edge of the storm shutter thereon, the storm shutter being received therein from an open front face of said base member so as to permit facilitated slided engagement of the upper peripheral edge of the storm shutter into said upper retainer assembly, (d) a generally L-shaped lock panel, said lock panel including a lower lock flange and an upwardly extending front flange, and (e) said lower lock flange being structured for secure coplanar engagement with said planar flange of said base member, co-planar securing of said lock flange to said planar flange resulting in affirmative retention of the lower peripheral edge of the storm shutter within said lower retainer assembly.

5. A storm shutter retainer system as recited in claim 4 wherein said upper retainer assembly comprises:

a) a header structure having an elongated configuration and a hollow interior extending along the length thereof to define a retainer channel within said header structure, b) said header structure including a rear flange and a front flange spaced outwardly from said rear flange, c) a top flange integrally attached to and interconnecting said rear and front flanges, d) each of said top, rear, and front flanges extending along the length of said header structure in collectively surrounding relation to said retainer channel, e) said retainer channel adapted for receiving an upper peripheral edge of the storm shutter in a retaining position therein, and f) connecting means mounted at least partially within said retaining channel for securing said header structure to the building structure.

6. A storm shutter retainer system as recited in claim 5 wherein said connecting means includes a connector element extending through said rear flange and includes a head portion disposed within said channel, said connecting means adapted to orient said connector element in an upwardly angled position to resist any upwardly directed cantilever forces exerted on said header structure through the storm shutter.

* * * * *